US006166693A

United States Patent [19]

Nalbandian et al.

[11] Patent Number: 6,166,693

[45] Date of Patent: Dec. 26, 2000

[54] TAPERED LEAKY WAVE ULTRAWIDE BAND MICROSTRIP ANTENNA

[75] Inventors: Vahakn Nalbandian, Tinton Falls, N.J.; Choon S. Lee, Dallas, Tex.

[73] Assignee: The United States of America as represented by the Secretary of the Army, Washington, D.C.

[21] Appl. No.: 09/285,185

[22] Filed: Mar. 9, 1999

Related U.S. Application Data

[63] Continuation-in-part of application No. 09/050,149, Mar. 30, 1998.

[51] Int. Cl.[7] ..... H01Q 1/38

[52] U.S. Cl. ..... 343/700 MS

[58] Field of Search ..... 343/700 MS, 895, 343/825; H01Q 1/38

[56] References Cited

U.S. PATENT DOCUMENTS

| | | | |
|---|---|---|---|
| 4,945,363 | 7/1990 | Hoffman | 343/895 |
| 5,479,180 | 12/1995 | Lenzing et al. | 343/895 |
| 5,847,682 | 12/1998 | Ke | 343/700 MS |

*Primary Examiner*—Don Wong
*Assistant Examiner*—Hoang Nguyen
*Attorney, Agent, or Firm*—Michael Zelenka; George B. Tereschuk

[57] ABSTRACT

The present invention is a microstrip antenna which produces ultrawide band leaky wave radiation. The antenna produces leaky wave radiation, then tapers the leaky wave radiation to produce an ultrawide bandwidth. The antenna includes tapered metal patches which taper the radiation. The antenna gives an ultrawide bandwidth performance of greater than a 4:1 ratio.

14 Claims, 8 Drawing Sheets

TAPERED LEAKY WAVE ULTRAWIDE BAND MICROSTRIP ANTENNA

CROSS REFERENCE TO RELATED APPLICATION

The present invention is a Continuation-in-Part of application Ser. No. 09/050,149, filed Mar. 30, 1998.

STATEMENT OF GOVERNMENT RIGHTS

The invention described herein may be manufactured, used and licensed by or for the Government for governmental purposes without the payment to us of any royalty thereon.

FIELD OF THE INVENTION

This invention relates in general to microstrip antennas, and particularly to wide bandwidth, leaky-wave transmission mode antennas.

BACKGROUND OF THE INVENTION

Microstrip antennas are used in many applications and have advantageous features such as being lightweight, having a low profile, being planar, and generally of relatively low cost to manufacture. Additionally, the planar structure of a microstrip antenna permits the microstrip antenna to be conformed to a variety of surfaces having different shapes. This results in the microstrip antenna being applicable to many military and commercial devices, such as use on aircraft or space antennas.

However, the application of many microstrip antennas are limited due to their inherent narrow, less than 10%, frequency bandwidth. While there have been attempts to increase this bandwidth, they have had limited success. Additionally, previous wideband antennas have been bulky and relatively complex such as horn, helix, or log periodic antennas. Therefore, there is a need for a wide bandwidth antenna that combines the benefits of a microstrip antenna with the wideband features of relatively more costly and complex antennas.

SUMMARY OF THE INVENTION

The present invention is an antenna comprising means for producing leaky wave radiation, and means for tapering the leaky wave radiation. In another embodiment, the invention is a method of producing a tapered wide band traveling wave from a microstrip antenna. In a further embodiment, the present invention is a tapered wide band traveling wave formed by producing leaky wave radiation and tapering the leaky wave radiation.

DETAILED DESCRIPTION OF THE PREFERRED EMBODIMENT

Figure 1:
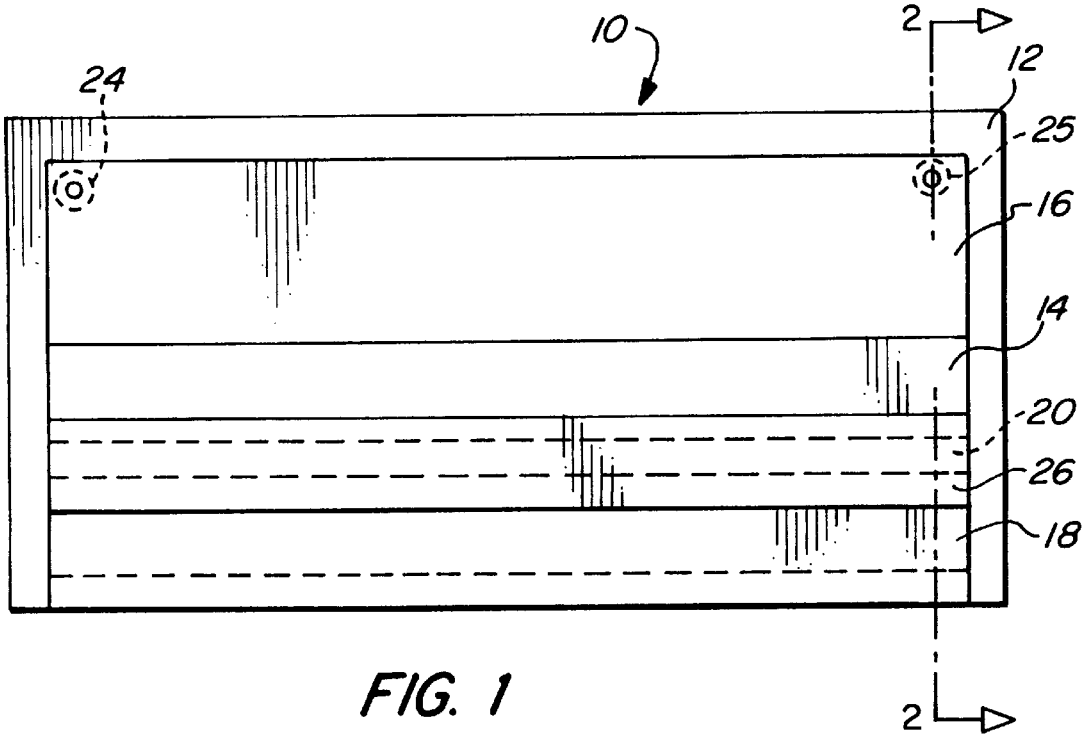
FIG. 1 is a plan view of one embodiment of the present invention.

FIG. 1 illustrates the wideband leaky-wave microstrip antenna 10 of the present invention. The leaky-wave microstrip antenna 10 has a lower rectangular dielectric layer 12 and upper rectangular dielectric layer 14. Placed on the lower layer 12 is a first rectangular conductive patch 16 and a second rectangular conductive patch 18. A gap 20 separates the first patch 16 and the second patch 18. A conductive coupling patch 26 is placed on the upper layer 14 positioned over the gap 20. The coupling patch 26 covers a portion or is placed over a portion of the first patch 16 and the second patch 18. The coupling patch 26 covers the entire width of the gap 20. A coaxial probe 24, which may be an SMA connector, is coupled to the first rectangular conductive patch 16 at one corner opposite the gap 20. Coaxial probe 24 provides electromagnetic energy, preferably in a microwave frequency range, to the leaky-wave antenna 10. The coaxial probe 24 is positioned at the longitudinal end of the conductive patch 16. The coaxial feed has an impedance of fifty ohms. A second coaxial probe 25 may be positioned at an opposing corner to obtain experimental data relating to the propagation and radiating properties of the antenna. The leaky-wave antenna 10 has a longitudinal length substantially longer than the lateral width. The length is at least twice as long as the width.

Figure 2:
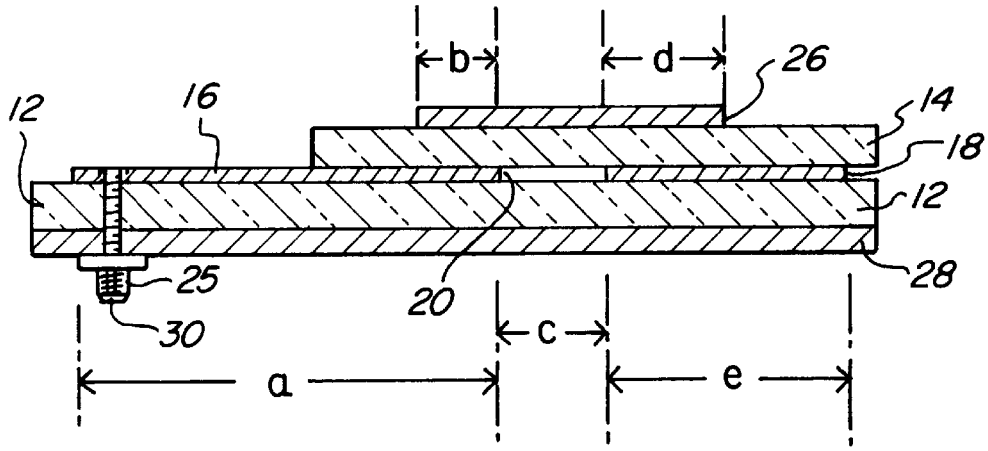
FIG. 2 is a cross section taken along line 2—2 in FIG. 1.

FIG. 2 is a cross section taken along line 2—2 in FIG. 1. FIG. 2 more clearly illustrates the structure of the present invention. The lower layer 12 is a dielectric material that may be made of Duroid dielectric material having a dielectric constant of approximately 2.2. However, other dielectric materials may be used, for example, ROHACELL 71 HF dielectric material having a dielectric constant of approximately 1.1. The lower the dielectric constant is, the wider the bandwidth becomes. The lower layer 12 may have a generally rectangular shape. Placed on the planar surface of the lower dielectric 12 is a conductive ground plane 28. The ground plane 28 may be made of any conductive material, such as silver or copper. The first patch 16 and the second patch 18 are formed of a conductive material, such as copper or silver, and are formed on the opposing planar surface of the lower layer 12. The first and second patches 16 and 18 may be formed on the lower layer 12 by any conventional means, such as deposition or etching, or may be attached with adhesive. The first and second patches 16 and 18 are illustrated having a generally rectangular shape, but due to the flexibility of the microstrip structure, various geometrical shapes are possible. The different shapes may be utilized to modify the antenna radiation patterns. However, in order to efficiently radiate in the leaky-wave transmission mode, the longitudinal length should be relatively long. This permits more energy to be radiated while the electromagnetic radiation travels longitudinally along the length of the antenna. Additionally, the longitudinal length of the leaky-wave antenna 10 should increase as the thickness decreases in order to compensate reduced radiation power in a unit longitudinal length. The first and second patches 16 and 18 are positioned so that a gap 20 is formed there between. An upper dielectric layer 14 is positioned partly on top of the first patch 16 and the second patch 18, bridging the gap 20. An upper coupling patch 26, which may be made of any conductive material, such as copper or silver, is placed on the opposing planar surface of upper dielectric surface 14. The coupling patch 26 is positioned over the gap 20 and covers a portion of the first patch 16 and the second patch 18. The coaxial probes 24 and 25 have a conductor 30 coupled to the first patch 16 and the lower dielectric layer 12. Only one coaxial probe is needed as a source. The other coaxial probe may be used for obtaining other experimental data. The present invention is similar to a prior invention by the same inventors entitled "Impedance Matching of A Double Layer Microstrip Antenna By A Microstrip Line Feed" presently designated as CECOM Docket #5296, which is herein incorporated by reference. That application was filed in the United States Patent and Trademark Office on Mar. 17, 1998, and given Ser. No. 09/040,006. This prior invention, while structurally similar, has a completely different mode of operation with a very narrow bandwidth.

Referring to FIGS. 1 and 2, distance a represents the lateral distance of first patch 16. Distance b represents the lateral distance over which coupling patch 26 overlaps first patch 16. Distance c represents the lateral distance of gap 20 between the first patch 16 and the second patch 18. Distance d illustrates the lateral distance overlapping portion of coupling patch 26 with second patch 18. Distance e represents the lateral distance of second patch 18.

Figure 3:
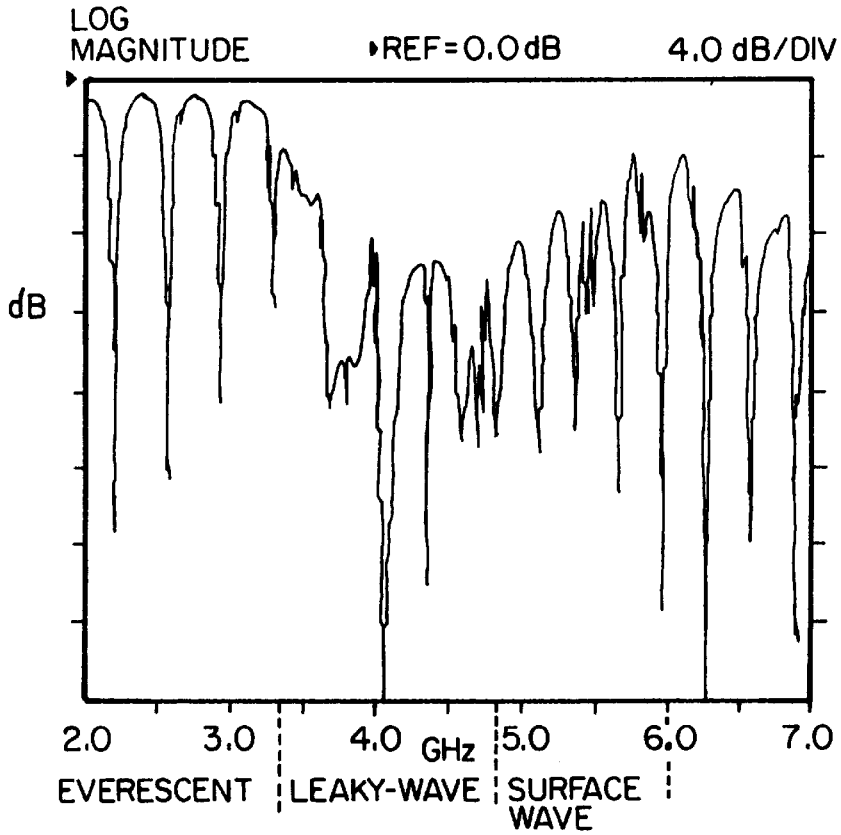
FIG. 3 is a graph illustrating the return loss as a function of frequency.

FIG. 3 is a graph illustrating the return loss as a function of frequency for a particular embodiment of the present invention. The X axis represents frequency in GHz and the Y axis represents magnitude in decibels. The X axis may be divided up into three regions representative of the propagation mode of the electromagnetic radiation. The evanescent region, the leaky-wave region, and the surface wave region. As the frequency increases further, a higher-order leaky mode may be excited. However, this mode usually radiates in an undesirable way. FIG. 3 represents the data from a first embodiment of the present invention that has been tested. In this first embodiment, a dielectric material, DUROID, having a dielectric constant of 2.2 was used. Additionally, the thickness of both the upper and lower layers of dielectric material was 62 mils or approximately 1.57 millimeters. Referring to FIG. 2, distance a was 2.4 centimeters, distance b was 0.4 centimeters, distance c was 0.3 centimeters, distance d was 0.4 centimeters, and distance e was 0.6 centimeters. Copper foil was used for the conductive patches and had a thickness of 0.7 mils or approximately 0.02 millimeters. The longitudinal length of the dielectric material was 30 centimeters and the longitudinal length of the copper foil was 28 centimeters. Accordingly, in this first embodiment the longitudinal length was substantially greater than the lateral width. The longitudinal length was greater than approximately eight times the lateral width. The double layer leaky-wave microstrip antenna was thermally bonded by using 1.5 mil or approximately 0.04 millimeters thick bonding film. The RF feed location was optimized along the direction perpendicular to the direction of propagation. The frequency range of the lowest order of leaky-mode propagation is measured from the values at which the transmission is small because most of the transmitted power is due to the surface mode propagation. The measured frequency band ratio is 1:1.35 and the experimental cut-off frequency is 3.4 GHz. This is consistent with the theoretical values of 1:1.354 and 3.71 GHz. Fabrication error and the edge effects in the cavity model may have contributed to the discrepancy between the theory and the experimental results.

Figure 4:
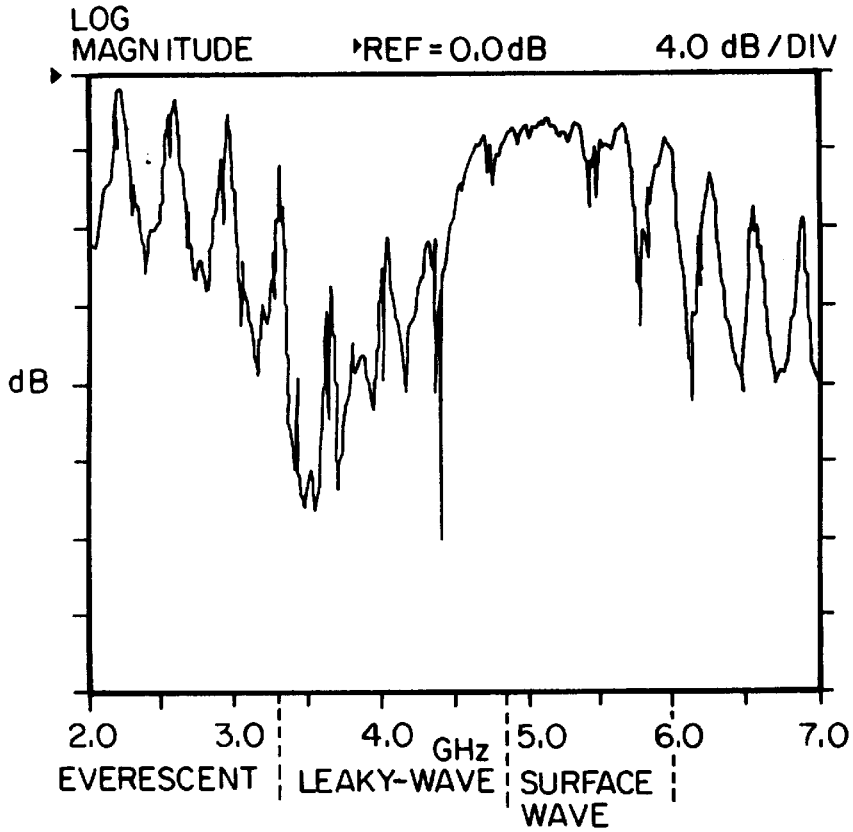
FIG. 4 is a graph illustrating the transmission loss as a function of frequency.

FIG. 4 is a graph illustrating the transmission loss as a function of frequency for the first embodiment described above. Similar to FIG. 3, the graph in FIG. 4 may be divided up into several regions, the evanescent region, the leaky-wave region and the surface wave region. From FIGS. 3 and 4 it should be appreciated that the first embodiment demonstrates the principal of a leaky-wave propagation mode in a microstrip structure.

Figure 5:
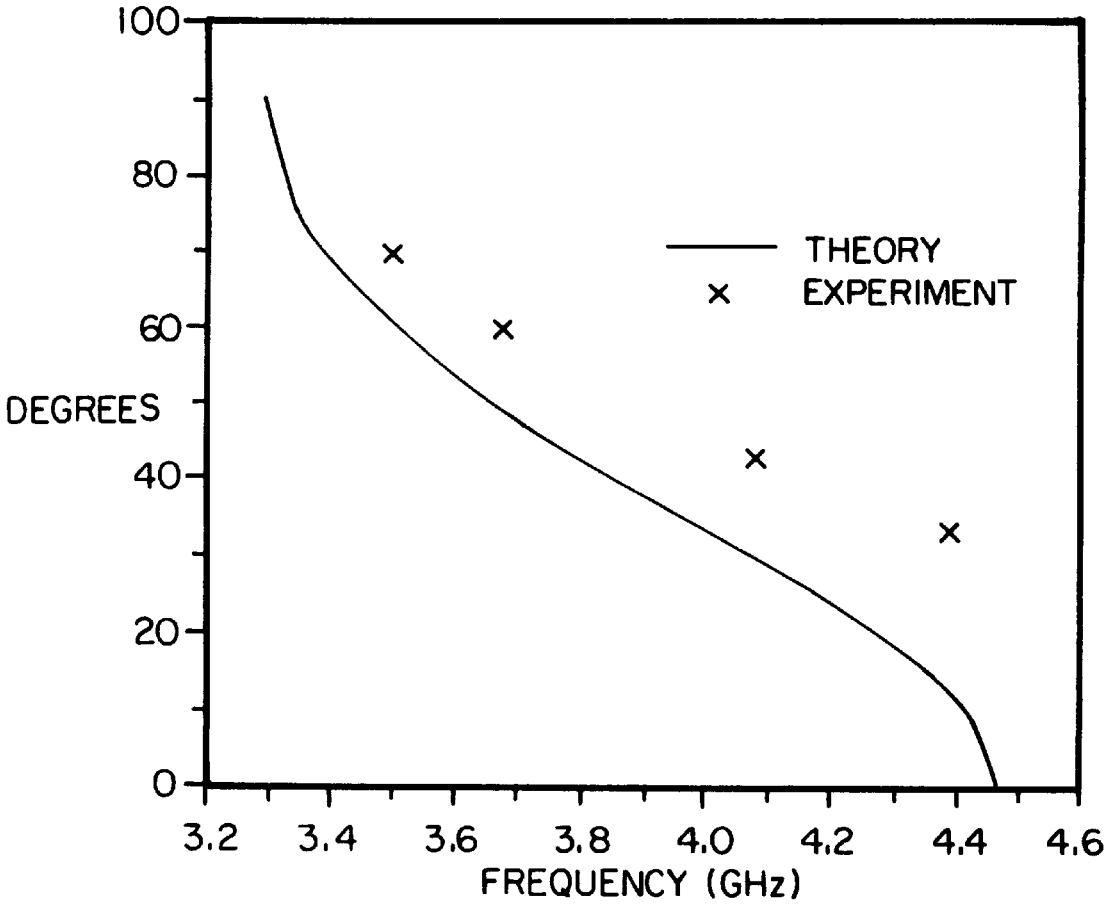
FIG. 5 is a graph illustrating the angle of the main peak from the ground plane as a function of frequency.

FIG. 5 is a graph illustrating the angle of the main peak from the ground plane as a function of frequency for the first embodiment described above. From FIG. 5, it is easily seen that there is relatively good agreement between the theoretical results and the actual experimental results. The experimental results differ slightly at relatively low or grazing angles, where the diffraction effect is strong.

Figure 6A:
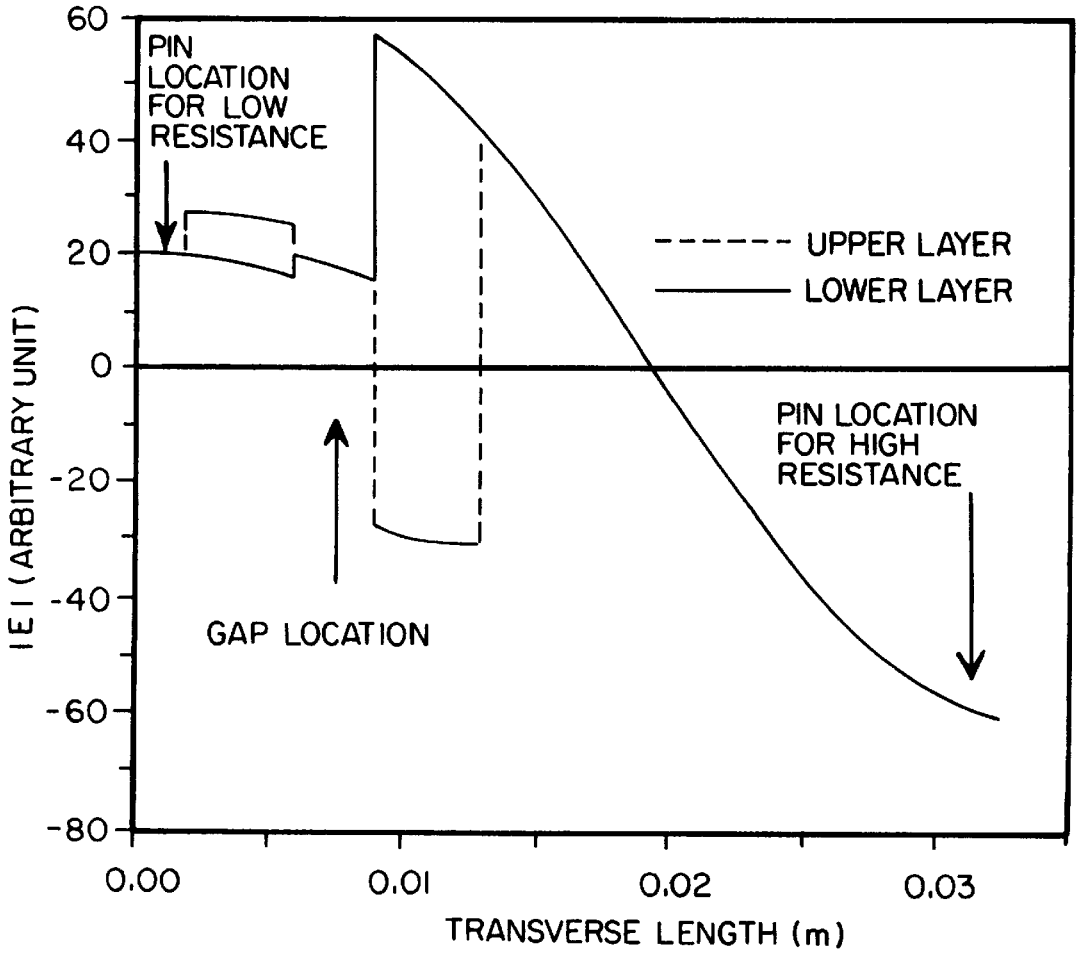
FIG. 6*a* is a graph illustrating the field distribution of the Z component of the electric field as a function of distance in the transverse or X direction.
Figure 6B:
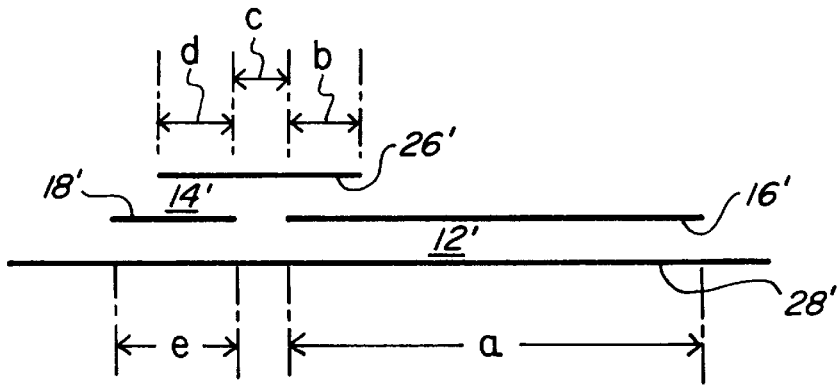
FIG. 6*b* is a schematic drawing illustrating different portions of the leaky-wave microstrip antenna of the present

FIG. 6*a* is a graph illustrating the field variation as a function of distance X in meters for the first embodiment of the present invention. FIG. 6*b* schematically illustrates the layered structure of the first embodiment. Line 18' represents the second patch 18; line 16' represents the first patch 16; space or gap 20' represents the gap 20; line 26' represents the coupling patch 26 and line 28' represents the ground plane 28, all illustrated in FIGS. 1 and 2. Accordingly, the space 12' between lines 18' and 16' and line 28' represents the lower dielectric layer 12 in FIG. 2, and the space 14' between lines 18', 16' and 26' represents the upper dielectric layer 14 in FIG. 2. Letters a, b, c, d, and e represent distances in the X direction of the respective associated surfaces.

1. Leaky Wave Antenna and Leaky Wave Radiation

The operation of the present invention can readily be appreciated. In a single microstrip line, the dominant mode is "quasi" transverse electromagnetic mode or TEM. However, this is a non-radiating surface mode. The higher order modes, however, become leaky when the propagation constant is less than that of the free space wave number, $K_0$. Therefore, a leaky-wave antenna may be realized by using an elongated microstrip line properly excited by a coaxial probe at the corner of one end. However, the surface-mode excitations need to be suppressed. The present invention, in utilizing a double layer substructure, facilitates variation of impedance to match the impedance at the feed or source, and therefore the suppression of surface mode excitations. The field distribution at the feed location is altered to match the input impedance by varying the locations and widths of metallic patches on the two layers of dielectric material. Once the input impedance is matched to a particular leaky-mode propagation, the surface modes will be likely to be suppressed because of impedance mismatch to all modes other than the intended leaky mode. This makes possible the planar construction of a leaky-wave microstrip antenna.

In theory, the present invention can be analyzed by using the cavity model to analyze the lowest-order leaky mode. The cutoff frequencies are obtained by solving a one dimensional problem assuming no field variation along the longitudinal direction. Assuming the attenuation constant is relatively small, the real part of the propagation constant is approximately given by:

$$\beta = \sqrt{\varepsilon_r k_o^2 - k_x^2}$$

Where $k_0$ is the free space wave number, $k_X$ is the wave vector component in the direction perpendicular to the wave propagation, and $\epsilon_r$ is the dielectric constant of the substrate. From this expression, we can obtain the frequency range within which the mode becomes leaky. When the operating frequency is less than the cutoff frequency, $f_C$, the wave becomes evanescent. On the other hand, when the propagation constant is larger than $k_o$, the mode becomes a surface wave, which propagates without any radiation. Thus, the frequency range for the leaky-wave mode of operation is given by:

$$f_c < f < \frac{f_c\sqrt{\varepsilon_r}}{\sqrt{\varepsilon_r - 1}}$$

It is noted that the bandwidth increases drastically as the dielectric constant becomes close to one. The radiation patterns are obtained from the equivalent magnetic circuits along the edges of the microstrip layers in the longitudinal direction. The main beam direction changes as the frequency shifts, since the propagation constant and the phase variation of the equivalent magnetic circuits depends on the frequency. The angle of the main beam from the ground plane is given by:

$$\theta_m = \cos^{-1}\frac{\beta}{k_o} = \cos^{-1}\sqrt{\varepsilon_r\left[1 - \left(\frac{f_c}{f}\right)^2\right]}$$

From the above theoretical analysis it should be appreciated that, as the relative dielectric constant approaches 1.0 the leaky wave antenna bandwidth becomes much wider. To verify this, a second embodiment of a leaky-wave microstrip antenna according to the present invention was fabricated using ROHACELL 71 HF dielectric material having a dielectric constant of approximately 1.1. Accordingly, the upper frequency range of the second embodiment should be 1.1 $f_C$ to 3.4 $f_C$. For the second embodiment, the lower and upper dielectric pieces were 29.5 centimeters long and 2 millimeters thick. A 30×10 centimeter copper plate ground plane was used having a thickness of 0.5 millimeters. The first, second and coupling patches were 28 centimeters long and had a thickness of 1.5 mil or approximately 0.04 millimeters with an adhesive on one side. Additionally, the second embodiment structure had the following dimensions, referring to FIG. 2, width dimension a being 35.2 millimeters; width dimension b being 6 millimeters; width dimension c being 5 millimeters, width dimension d being 6 millimeters, and width dimension e being 9.2 millimeters. Accordingly, in this second embodiment the longitudinal length was substantially greater than the lateral width. The longitudinal length was greater than approximately five times the lateral width. This second embodiment leaky-wave microstrip antenna had a frequency range of 3.2 to 10.2 GHz or 1:3.2 ratio.

It should be readily appreciated that the present invention, matches the input impedance to a particular leaky mode propagation by shifting the gap location, while suppressing the other modes, thereby making possible a wideband leaky-wave microstrip antenna. The planar structure of the microstrip antenna of the present invention, with its relatively wide frequency bandwidth, makes possible the application of the present invention to various geometrical shapes which can be utilized to modify the radiation patterns.

2. Tapered Leaky-Wave Microstrip Antenna and Tapered Leaky Wave Radiation

In a microstrip structure, the fundamental mode does not radiate while traveling along the microstripline and a higher-order mode must be excited for proper radiation. Feeding the antenna for the dominant mode is relatively simple and the procedure is well established. However, the excitation of a higher-order mode requires more elaborate feeding scheme. The present invention does this with a double-layer structure, which is easy to implement for a high-order traveling wave in a microstrip structure. The input impedance of the double layer traveling wave antenna is matched by varying widths of the metal patches, or strips, in the two layers of the microstrip and consequently the field strength at the feed.

The important criterion for the leaky wave is that the operating frequency of the traveling wave must be above the cutoff frequency, otherwise the wave becomes evanescent. Another condition for the traveling wave to be leaky is that the propagation constant of the traveling wave is less than that in free space. When the frequency is sufficiently high such that the propagation constant exceeds the free space wave number, the mode becomes a surface wave, which propagates along the microstrip without any radiation. These two conditions limit the bandwidth of the double layer leaky wave antenna. The frequency range for the leaky mode radiation is given by:

$$f_c < f < \frac{f_c\sqrt{\varepsilon_r}}{\sqrt{\varepsilon_r - 1}}$$

where $f_c$ is the cutoff frequency of the leaky mode and $\epsilon_r$ is the dielectric constant of the substrate. Note that the bandwidth can be increased drastically as $\epsilon_r$ approaches 1. For a large bandwidth, the substrate material has to have a dielectric constant very close to 1, while maintaining the mechanical strength to support the microstriplines. However, materials with an extremely low dielectric constant, such as foam like materials, have poor mechanical and thermal properties and their dielectric constant will change from bonding the several layers and copper strips together.

Figure 7A:
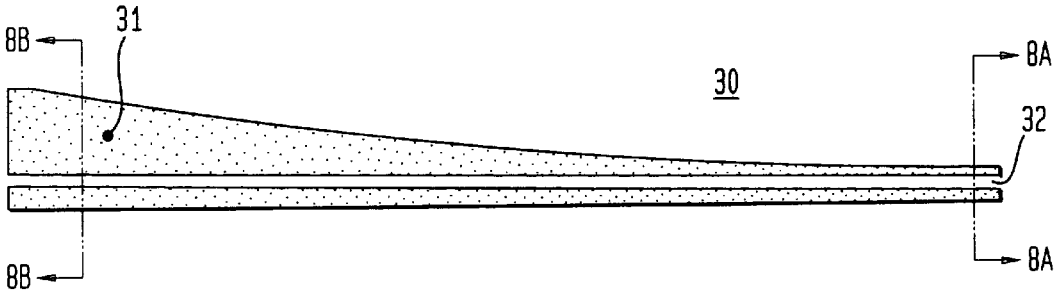
FIG. 7A is a top view drawing that shows the tapering of the top side of the bottom dielectric layer.
Figure 7B:
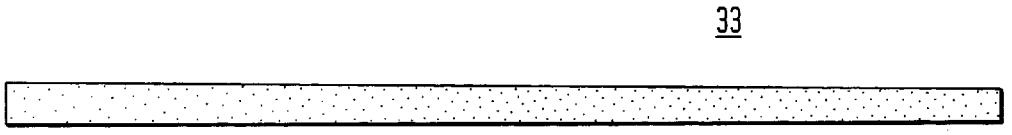
FIG. 7B is a top view drawing that shows the tapering of the top side of the top dielectric layer.
Figure 8A:
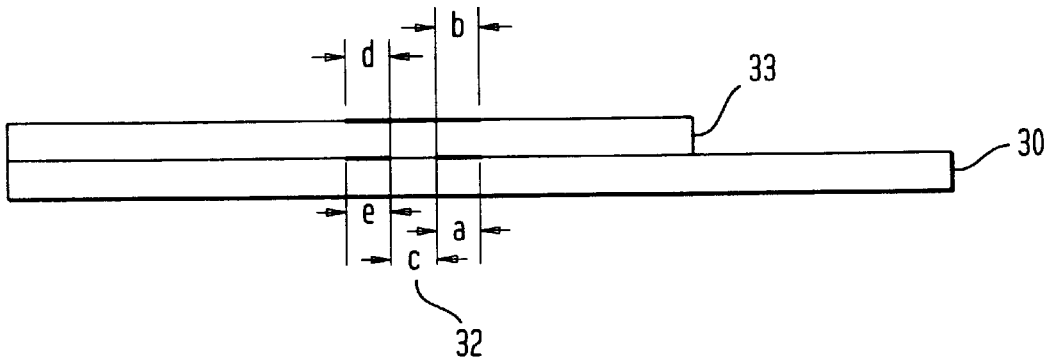
FIGS. 8A and 8B are end view drawings of the tapered leaky wave ultrawide band microstrip antenna depicted in FIGS. 7A and 7B.
Figure 8B:
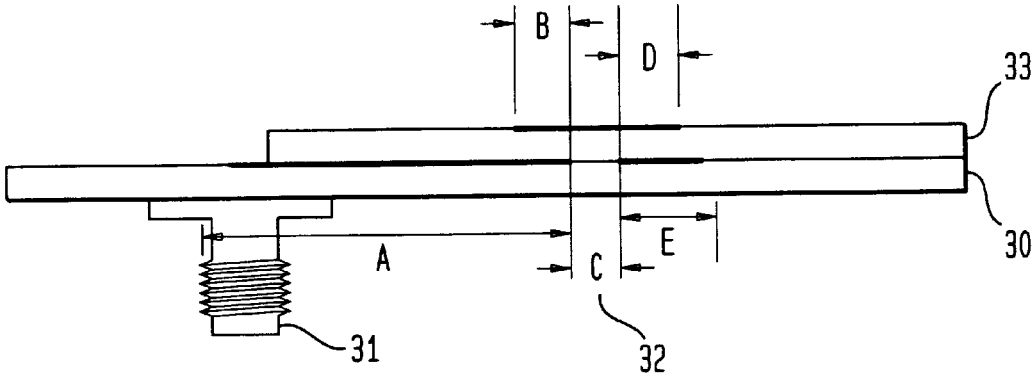

The present invention achieves a wider bandwidth by tapering the double-layer structure as shown in the FIGS. 7A–7B top view and the FIGS. 8A–8B end view drawings. Referring now to FIG. 7A, this is a top view drawing of the double-layer structure that shows the tapering of the top side of the bottom dielectric layer 30, showing a gap 32 and SMA connection point 31. Lines 8A and 8B in FIG. 7A correspond to the end views depicted in FIGS. 8A and 8B, respectively. FIG. 7B is a top view drawing of the double-layer structure that shows the tapering of the top side of the top dielectric layer 33. Referring back to FIG. 7A, the cutoff frequency in this case is not constant as in the uniform structure, but gradually increases as the wave propagates from the SMA feed 31. At a low frequency operation, the wave leaks at the region near the SMA feed 31. As the frequency increase, the wave starts at the SMA feed 31 as a surface wave. However, as the wave travels along the narrower region of the patches, or strips, the propagation constant becomes smaller than the free space wave number because of its increased cutoff frequency. Thus the wave leaks over a wide range of frequency radiating at its proper place of radiation. The bandwidth can be increased indefinitely by designing the antenna properly.

The tapered shape of the antenna can be hyperbolic, parabolic, linear, a transcendental function such as cosine, a Cheby-Shev polynomial, a combination of any of the above, or any other shape that provides a gradual transition of the thickness of the metal strips from wide to narrow, as shown in FIG. 7A. The present invention will taper the radiation when the widest metal strip, or patch, which is connected to the SMA probe 31 is tapered. However, the other metal strips, or patches, and the gap 32, can also be tapered to improve the performance of the present invention.

Experimental Results.

This double layer tapered leaky wave microstrip antenna was fabricated as shown in the FIGS. 7A–7B top views and the FIGS. 8A–8B end views. A parabolic taper was used. Duroid by Rogers Corp. was used as the dielectric material with a dielectric constant of 2.2 and thickness of 62 mils for each layer. This Duroid had 1.4 mil copper, indicated by the thickened lines in FIGS. 8A and 8B, on one (top layer) or two (bottom layer) sides. FIG. 8A depicts an end view taken along line 8A of FIG. 7A depicting the FIG. 7B top dielectric layer 33 placed on top of the FIG. 7A bottom dielectric layer 30, along with the FIG. 7A gap 32. In FIGS. 8A and 8B, the thickened lines show electrodeposited copper cladding on the indicated surfaces. In FIG. 8A, distances a, b, c, d and e are each 0.12-inch wide, and distance c is also designated as gap 32. FIG. 8B depicts an other end view taken along line 8B of FIG. 7A depicting the FIG. 7B top dielectric layer 33 placed on top of the FIG. 7A bottom dielectric layer 30, the FIG. 7A gap 32 and the SMA feed 31. In FIG. 8B, distance A is 0.96 inch, distance B is 0.16 inch, distance C is 0.12 inch, distance D is 0.16 inch, distance E is 0.24 inch and distance C is also designated as gap 32. This double layer microstrip antenna was thermally bonded using a 1.5 mil thick bonding film. The center conductor of a SMA probe 31 was attached to the mid-layer copper 0.12 inches from the corner.

Figure 9:
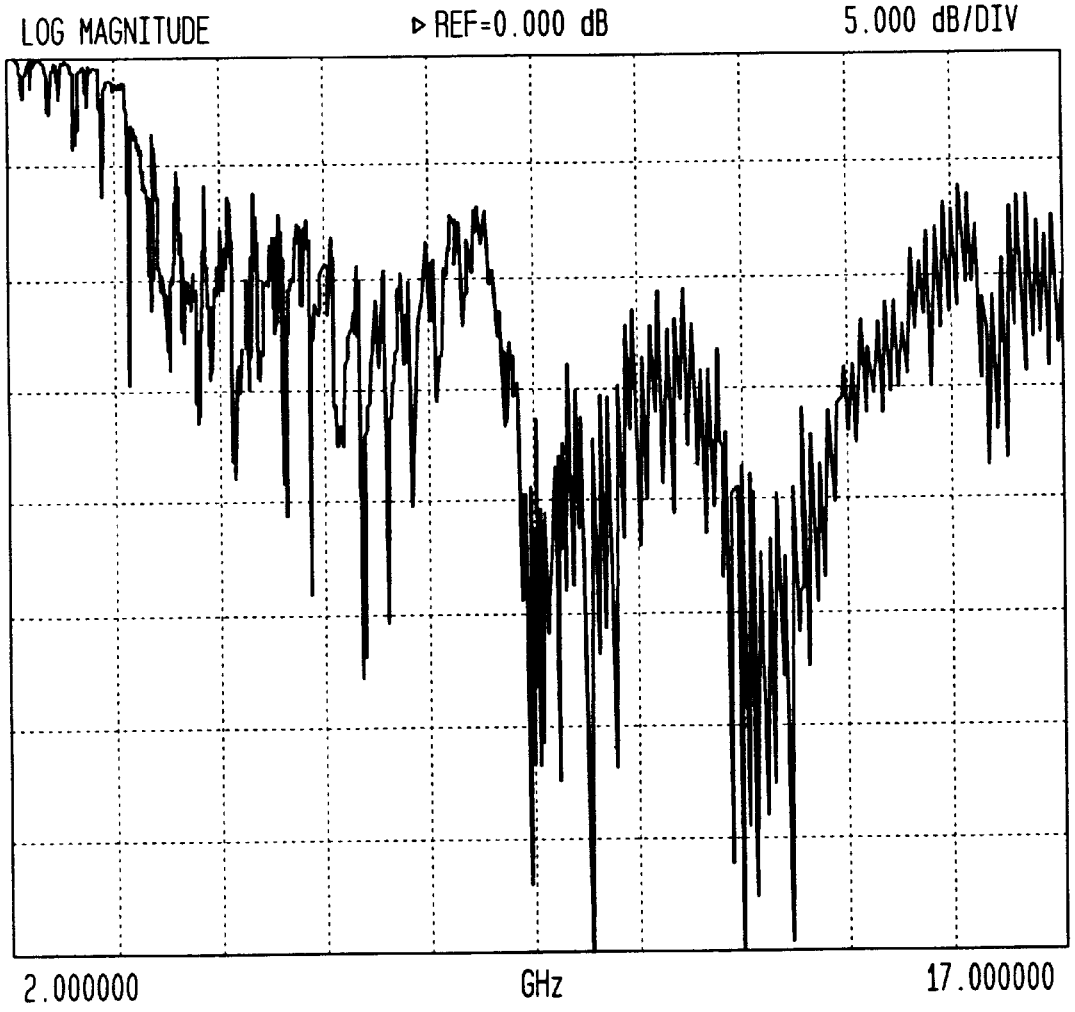
FIG. 9 shows the return loss as a function of frequency of the antenna of FIGS. 7A–7B and 8A–8B.
Figure 10:
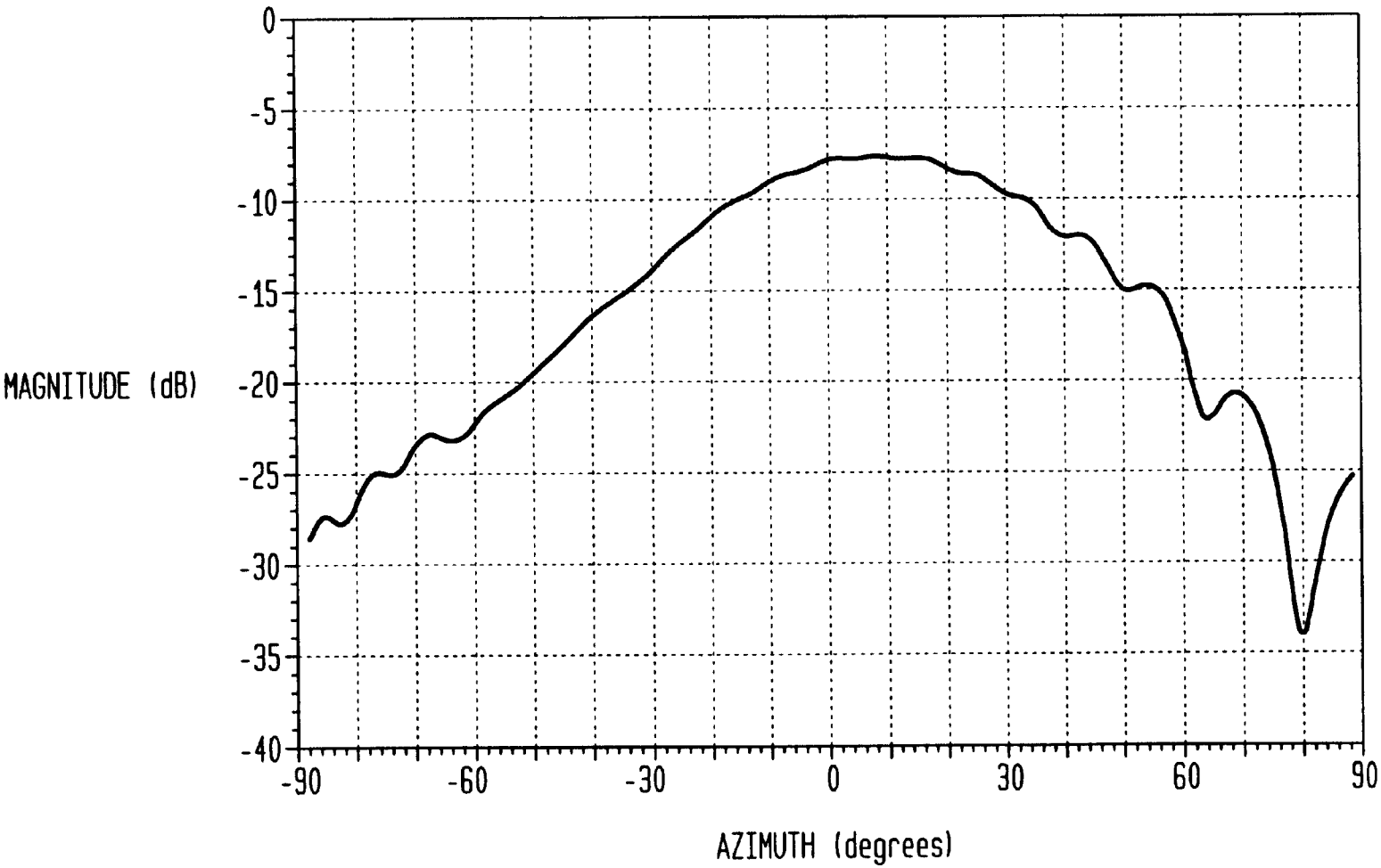
FIG. 10 shows the H-plane radiation pattern at 4.1 Ghz.

Using the cavity model, the computed cutoff frequency at the widest end of the copper strips near the RF input is 3.6 GHz and that at the narrowest end is 11.05 GHz. Using the above equation will get 35.4% extension to the upper frequency limit, i.e. to 15.0 GHz. From return loss as a function of frequency data of FIG. 9, the frequency bandwidth is measured to be from 3.71 to 14.86, which is very close to the theoretical values. The experimental error is caused mainly by fabrication errors. FIG. 10 shows a typical H plane antenna pattern at 4.1 GHz. Other good antenna patterns were measured between 3.7 and 14.8 GHz.

The present invention gives ultra-wideband performance of a 4:1 frequency ratio. The theoretical values have agreed well with the experimental results. This ultra wideband performance can be further improved by:

a) Making the width difference between the two ends larger.

b) Utilizing a better taper design, e.g. Chebyshev polynomial, log periodic function, a cosine function c) Using a rugged new lower dielectric material (when available) to raise the upper frequency limit;

d) Using non-rugged foam like dielectric material.

Various modifications may be made without departing from the spirit and scope of this invention.

We claim:

1. An antenna comprising:

a means for producing leaky wave radiation;

a means for tapering the leaky wave radiation;

said means for producing leaky wave radiation having a means for matching an input impedance of the antenna to a leaky wave mode of propagation;

said leaky wave radiation having a frequency range;

said means for producing leaky wave radiation also having a means for preventing and suppressing radiation caused by a plurality of surface mode excitations;

a microstrip having a plurality of layers; and a plurality of patches located on the plurality of layers;

wherein the locations and widths of the plurality of patches on the plurality of layers are such that the input impedance of the antenna matches the leaky wave propagation mode of the radiation.

2. The antenna of claim 1, wherein the frequency range for the leaky wave radiation produced by the antenna is:

$$f_c < f < \frac{f_c\sqrt{\varepsilon_r}}{\sqrt{\varepsilon_r - 1}}$$

where $f_c$ is the cutoff frequency of the leaky wave mode of propagation and $\epsilon_r$ is a dielectric constant of a substrate of the antenna.

3. The antenna of claim 2, wherein the means for tapering the leaky wave radiation comprises at least one strip which has a gradually tapered shape from wide to narrow.

4. The antenna of claim 3, wherein the gradually tapered shape is at least partially linear.

5. The antenna of claim 3, wherein the gradually tapered shape is at least partially hyperbolic.

6. The antenna of claim 3, wherein the gradually tapered shape is at least partially a transcendental function.

7. The antenna of claim 3, wherein the gradually tapered shape is at least partially a Chebyshev polynomial.

8. A method of producing a tapered ultra wide band traveling wave from a microstrip antenna comprising the steps of:

producing leaky wave radiation tapering the leaky wave radiation;

matching an input impedance of the antenna to a leaky wave mode of propagation;

preventing and suppressing radiation caused by a plurality of surface mode excitations;

forming said microstrip with a plurality of layers;

locating a plurality of patches on said plurality of layers;

positioning the locations and widths of the plurality of patches on the plurality of layers such that the input impedance of the antenna matches the leaky wave propagation mode of the radiation; and said leaky wave radiation having a frequency range expressed in the equation:

$$f_c < f < \frac{f_c\sqrt{\varepsilon_r}}{\sqrt{\varepsilon_r - 1}}$$

where said $f_c$ is the cutoff frequency of the leaky wave radiation and said $\epsilon_r$ is a dielectric constant of a substrate of the antenna.

9. An article of manufacture comprising:

a tapered ultra wide band traveling wave formed by:

producing leaky wave radiation with a means for producing leaky wave radiation;

tapering the leaky wave radiation with a means for tapering the leaky wave radiation;

a means for producing leaky wave radiation having a means for matching an input impedance of the antenna to a leaky wave mode of propagation;

said leaky wave radiation having a frequency range;

said means for producing leaky wave radiation also having a means for preventing and suppressing radiation caused by a plurality of surface mode excitations;

a microstrip having a plurality of layers;

a plurality of patches located on the plurality of layers;

wherein the locations and widths of the plurality of patches on the plurality of layers are such that the input impedance of the antenna matches the leaky wave propagation mode of the radiation; and the frequency range of the leaky wave radiation expressed in the equation:

$$f_c < f < \frac{f_c\sqrt{\varepsilon_r}}{\sqrt{\varepsilon_r - 1}}$$

where $f_c$ is the cutoff frequency of the leaky mode and $\epsilon_r$ is the dielectric constant of the substrate of the antenna.

10. An antenna comprising:

a microstrip for producing leaky wave radiation, said microstrip having an upper layer and a lower layer; and a plurality of patches located on the upper and lower layers, where at least one of the patches is tapered for tapering the leaky wave radiation.

11. The antenna of claim 10 wherein the plurality of patches comprise a first tapered patch located on the lower layer of the microstrip;

a second tapered patch located on the lower layer of the microstrip;

a gap located on the lower layer of the microstrip, in between the first and second patches;

a third tapered patch located on the upper layer, above the gap, so that the third patch is electromagnetically coupled to the lower layer;

wherein the three patches and the gap are positioned so that the input impedance of the antenna matches a leaky wave propagation mode of the radiation.

12. The antenna of claim 11 wherein:

the patches comprise a conductive material;

the upper and lower layers comprise a dielectric material;

a conductive ground plane is located on the lower layer; and an input probe for providing a source of electromagnetic energy to the antenna is coupled to the lower layer and the first patch.

13. The antenna of claim 10, wherein the shape of the at least one tapered patch is at least partially selected from the group consisting of:

a linear shape, a hyperbolic shape, a Chebyshev polynomial shape, a transcendental function shape.

14. The antenna of claim 10, wherein the frequency range of the leaky wave radiation is:

$$f_c < f < \frac{f_c\sqrt{\varepsilon_r}}{\sqrt{\varepsilon_r - 1}}$$

where $f_c$ is the cutoff frequency of the leaky mode and $\epsilon_r$ is the dielectric constant of the substrate of the antenna.

* * * * *